US011374331B1

(12) United States Patent
Chen

(10) Patent No.: US 11,374,331 B1
(45) Date of Patent: Jun. 28, 2022

(54) BASE STATION ANTENNA INCLUDING FABREY-PEROT CAVITIES

(71) Applicant: CommScope Technologies LLC, Hickory, NC (US)

(72) Inventor: Changfu Chen, Jiangsu (CN)

(73) Assignee: CommScope Technololgies LLC, Hickory, NC (US)

( * ) Notice: Subject to any disclaimer, the term of this patent is extended or adjusted under 35 U.S.C. 154(b) by 0 days.

(21) Appl. No.: 17/621,599

(22) PCT Filed: Jun. 29, 2020

(86) PCT No.: PCT/US2020/040042
§ 371 (c)(1),
(2) Date: Dec. 21, 2021

(87) PCT Pub. No.: WO2021/003081
PCT Pub. Date: Jan. 7, 2021

(30) Foreign Application Priority Data

Jul. 3, 2019 (CN) ..... 201910593734.8

(51) Int. Cl.
*H01Q 21/06* (2006.01)
*H01Q 1/24* (2006.01)
*H01Q 19/185* (2006.01)

(52) U.S. Cl.
CPC ..... *H01Q 19/185* (2013.01); *H01Q 1/24* (2013.01); *H01Q 1/246* (2013.01); *H01Q 21/06* (2013.01)

(58) Field of Classification Search
CPC ..... H01Q 19/185; H01Q 1/246; H01Q 21/06; H01Q 1/24
USPC ..... 343/836
See application file for complete search history.

(56) References Cited

U.S. PATENT DOCUMENTS

2004/0061647 A1 4/2004 Roper
2012/0280874 A1* 11/2012 Kim ..... H01Q 3/06 343/763
2018/0026356 A1* 1/2018 Schmalenberg ..... H01Q 1/3283 343/713
2018/0323513 A1 11/2018 Varnoosfaderani et al.
2018/0331419 A1* 11/2018 Varnoosfaderani ..... H01Q 21/0006
2019/0103660 A1 4/2019 Zimmerman et al.
(Continued)

OTHER PUBLICATIONS

"International Search Report and Written Opinion of the International Searching Authority", International Application No. PCT/US2020/040042, dated Sep. 30, 2020, 22 pp.
(Continued)

*Primary Examiner* — Hai V Tran
(74) *Attorney, Agent, or Firm* — Myers Bigel, P.A.

(57) ABSTRACT

A base station antenna comprises two arrays of radiating elements each configured to emit electromagnetic radiation; two backplanes each configured to reflect respective electromagnetic radiation outwardly, wherein the two backplanes are positioned with a mechanical tilt relative to each other such that the respective electromagnetic radiation are directed in different directions in the azimuth plane; and two plate assemblies each configured to reflect a first portion of received electromagnetic radiation inwardly while allowing a second portion to pass outwardly through the respective plate assembly, where the two plate assemblies are positioned to form two Fabry-Perot cavities with the two backplanes, respectively.

24 Claims, 7 Drawing Sheets

(56) References Cited

U.S. PATENT DOCUMENTS

| | | | | |
|---|---|---|---|---|
| 2020/0044327 | A1* | 2/2020 | Ding | H01Q 21/29 |
| 2020/0076078 | A1* | 3/2020 | Tehran | H01Q 5/50 |
| 2020/0220252 | A1* | 7/2020 | Xiao | H01Q 1/48 |
| 2020/0235489 | A1* | 7/2020 | Xiao | H01Q 21/22 |
| 2020/0411967 | A1* | 12/2020 | Liu | H01Q 19/106 |

OTHER PUBLICATIONS

Zhang, Lei , et al., "Realization of Low Scattering for a High-Gain Fabry-Perot Antenna Using Coding Metasurface", IEEE Transactions on Antennas and Propagation, vol. 65, No. 7, Jul. 2017, May 3, 2017, pp. 3374-3383.

* cited by examiner

BASE STATION ANTENNA INCLUDING FABREY-PEROT CAVITIES

CROSS-REFERENCE TO RELATED APPLICATIONS

The present application is a 35 U.S.C. § 371 national stage application of PCT Application No. PCT/US2020/040042, filed on Jun. 29, 2020, which itself claims priority to Chinese Patent Application No. 201910593734.8, filed Jul. 3, 2019, the entire contents of both of which are incorporated herein by reference as if set forth fully herein in their entireties.

FIELD

The present invention relates to cellular communication systems and, more particularly, to base station antennas.

BACKGROUND

Each cell in a cellular communication system has one or more antennas that are configured to provide two-way wireless radio frequency (RF) communication to mobile users geographically located within the cell. While a single antenna may be used to provide cellular service throughout the cell, multiple antennas are typically used and each antenna is configured to provide service to a respective sector of the cell. Typically, the multiple sector antennas are arranged on a tower and serve respective sectors by forming radiation beams that face outwardly in different directions in the horizontal or "azimuth" plane.

FIG. 1 is a schematic diagram of a conventional base station 10. As shown in FIG. 1, base station 10 includes an antenna 20 that may be mounted on raised structure 30. In the depicted embodiment, the raised structure 30 is a small antenna tower, but it will be appreciated that a wide variety of mounting locations may be used including, for example, utility poles, buildings, water towers and the like. As is further shown in FIG. 1, the base station 10 also includes base station equipment, such as baseband units 40 and radios 42. A single baseband unit 40 and a single radio 42 are shown in FIG. 1 to simplify the drawing, but it will be appreciated that more than one baseband unit 40 and/or radio 42 may be provided. Additionally, while the radio 42 is shown as being co-located with the baseband unit 40 at the bottom of the raised structure 30, it will be appreciated that in other cases the radio 42 may be a remote radio head that is mounted on the raised structure 30 adjacent the antenna 20. The baseband unit 40 may receive data from another source such as, for example, a backhaul network (not shown) and may process this data and provide a data stream to the radio 42. The radio 42 may generate radio frequency ("RF") signals that include the data encoded therein and may amplify and deliver these RF signals to the antenna 20 for transmission via a cabling connection 44. It will also be appreciated that the base station 10 of FIG. 1 will typically include various other equipment (not shown) such as, for example, a power supply, backup batteries, a power bus, Antenna Interface Signal Group ("AISG") controllers and the like.

Typically, a base station antenna includes one or more phase-controlled arrays of radiating elements, with the radiating elements arranged in one or more vertical columns (a "column" herein, unless otherwise specified, refers to a column oriented in a vertical direction) when the antenna is mounted for use. Herein, "vertical" refers to a direction that is perpendicular relative to the plane defined by the horizon.

Elements in the antenna that are referred to as being arranged, disposed or extending in a vertical direction means that when the antenna is mounted on a support structure for operation and there is no physical tilt, the elements are arranged, disposed or extending in a direction that is perpendicular relative to the plane defined by the horizon.

In a cellular base station having a conventional "3-sector" configuration, each sector antenna typically has a beamwidth of about 65° (a "beamwidth" herein, unless otherwise specified, refers to a half-power (−3 dB) beamwidth in an azimuth plane), as shown in FIG. 2A. A base station may alternatively have a 6-sector configuration that may be used to increase system capacity. In a 6-sector cellular configuration, each sector antenna may have a narrower beamwidth, for example, a beamwidth of about 33° or 45° that is typically used in a cell with 6 sectors. Multiple sectors in a 6-sector cellular configuration may be covered by a multi-beam antenna that generates multiple antenna beams having different azimuth boresight pointing directions. A dual-beam antenna is one type of multi-beam antenna. An exemplary radiation pattern in the azimuth plane for a dual-beam antenna is shown in FIG. 2B. As shown in FIG. 2B, the radiation pattern has two antenna beams that have different azimuth boresight pointing directions, and each antenna beam has a narrower beamwidth of about 33°. The two antenna beams cover 2 adjacent sectors in a cell with 6 sectors.

A narrower beamwidth may be obtained by using multiple columns of radiating elements in a base station antenna, for example 3 or 4 columns of radiating elements. It is also feasible to obtain a narrower beamwidth by using an RF lens in a base station antenna.

SUMMARY

A first aspect of this invention is to provide a base station antenna. The base station antenna may comprise: a first array of radiating elements configured to emit first electromagnetic radiation; a second array of radiating elements configured to emit second electromagnetic radiation; a first backplane, the first array of radiating elements being disposed on an outer surface of the first backplane, and the first backplane being configured to reflect the first electromagnetic radiation outwardly; a second backplane, the second array of radiating elements being disposed on an outer surface of the second backplane, and the second backplane being configured to reflect the second electromagnetic radiation outwardly, wherein the first and second backplanes are positioned with a mechanical tilt relative to each other such that a direction of the first electromagnetic radiation is different from a direction of the second electromagnetic radiation in an azimuth plane; a first plate assembly configured to reflect a first portion of received electromagnetic radiation inwardly while allowing a second portion of the received electromagnetic radiation to pass outwardly through the first plate assembly, the first plate assembly being positioned to form, with the first backplane, a first Fabry-Perot cavity for the first electromagnetic radiation; and a second plate assembly configured to reflect a first portion of received electromagnetic radiation inwardly while allowing a second portion of the received electromagnetic radiation to pass outwardly through the second plate assembly, the second plate assembly being positioned to form, with the second backplane, a second Fabry-Perot cavity for the second electromagnetic radiation.

A second aspect of this invention is to provide a base station antenna. The base station antenna may comprise: a first array of radiating elements that are configured to emit first electromagnetic radiation; a second array of radiating elements that are configured to emit second electromagnetic radiation; a first backplane comprising a first conductor plane disposed on an inner surface of the first backplane, the first array of radiating elements being disposed on an outer surface of the first backplane; a second backplane comprising a second conductor plane disposed on an inner surface of the second backplane, the second array of radiating elements being disposed on an outer surface of the second backplane, wherein the first and second backplanes are positioned with a mechanical tilt relative to each other such that an emission direction of the first electromagnetic radiation is different from an emission direction of the second electromagnetic radiation in an azimuth plane; a first plate assembly comprising a first substrate and a plurality of first units arranged in an array disposed on the first substrate, a dimension of the first unit being a sub-wavelength of the first electromagnetic radiation, wherein the first plate assembly is positioned such that the array in which the plurality of first units are arranged receives the first electromagnetic radiation and forms, with the first conductor plane, a first Fabry-Perot cavity for the first electromagnetic radiation; and a second plate assembly comprising a second substrate and a plurality of second units arranged in an array disposed on the second substrate, a dimension of the second unit being a sub-wavelength of the second electromagnetic radiation, wherein the second plate assembly is positioned such that the array in which the plurality of second units are arranged receives the second electromagnetic radiation and forms, with the second conductor plane, a second Fabry-Perot cavity for the second electromagnetic radiation.

A third aspect of this invention is to provide a base station antenna. The base station antenna may comprise: a first array of radiating elements that are configured to emit first electromagnetic radiation; a second array of radiating elements that are configured to emit second electromagnetic radiation and positioned with a mechanical tilt relative to the first array of radiating elements such that an emission direction of the first electromagnetic radiation is different from an emission direction of the second electromagnetic radiation in an azimuth plane; a first reflector that is configured to reflect the first electromagnetic radiation outwardly; a second reflector that is configured to reflect the second electromagnetic radiation outwardly; a first plate assembly that is configured to reflect a first portion of received electromagnetic radiation inwardly while allowing a second portion of the received electromagnetic radiation to pass outwardly through the first plate assembly, the first plate assembly being positioned to form, with the first reflector, a first Fabry-Perot cavity for the first electromagnetic radiation; and a second plate assembly that is configured to reflect a first portion of received electromagnetic radiation inwardly while allowing a second portion of the received electromagnetic radiation to pass outwardly through the second plate assembly, the second plate assembly being positioned to form, with the second reflector, a second Fabry-Perot cavity for the second electromagnetic radiation.

A fourth aspect of this invention is to provide a base station antenna. The base station antenna may comprise: a first array of radiating elements that is configured to emit first electromagnetic radiation; a second array of radiating elements that is configured to emit second electromagnetic radiation; a first backplane, the first array of radiating elements being disposed on an outer surface of the first backplane, and the first backplane being configured to reflect the first electromagnetic radiation outwardly; a second backplane, the second array of radiating elements being disposed on an outer surface of the second backplane, and the second backplane being configured to reflect the second electromagnetic radiation outwardly, wherein the first and second backplanes are positioned with a mechanical tilt relative to each other such that a direction of the first electromagnetic radiation is different from a direction of the second electromagnetic radiation in an azimuth plane; and a first plate assembly that is configured to reflect a first portion of received electromagnetic radiation inwardly while allowing a second portion of the received electromagnetic radiation to pass outwardly through the first plate assembly, the first plate assembly being positioned to form, with the first backplane, a first Fabry-Perot cavity for the first electromagnetic radiation.

Further features of the present invention and advantages thereof will become apparent from the following detailed description of exemplary embodiments with reference to the attached drawings.

Figure 1:
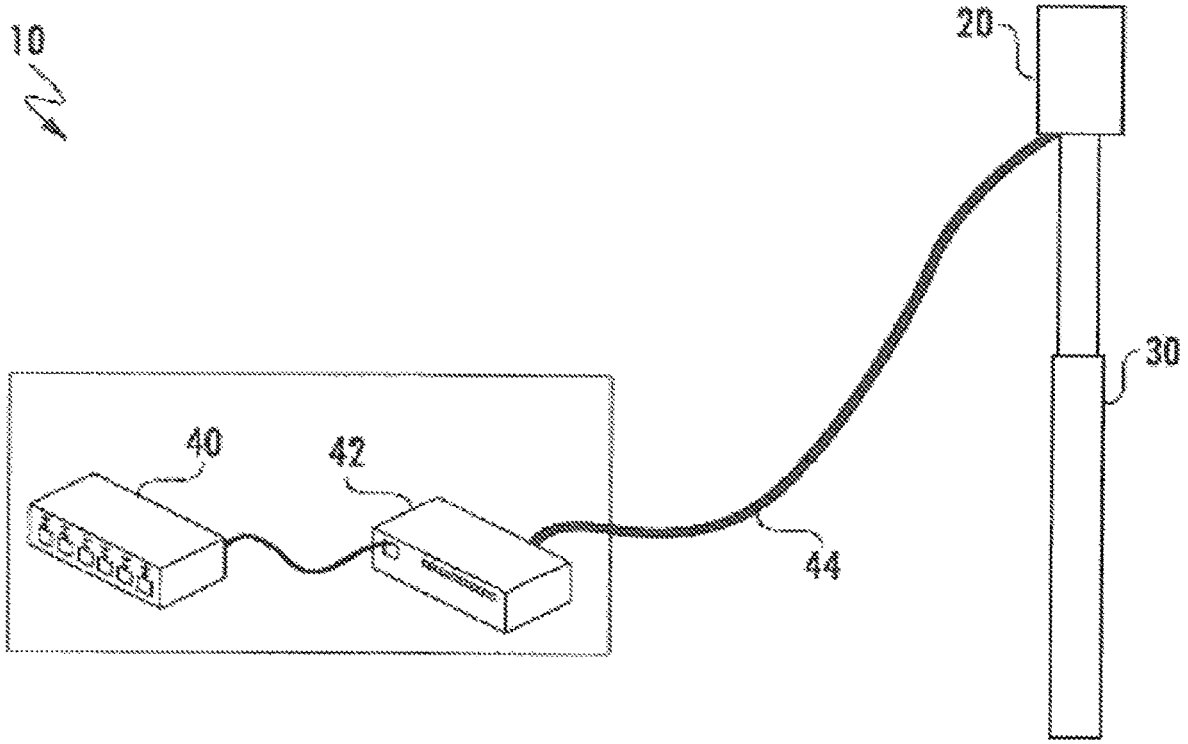
FIG. 1 is a simplified schematic diagram showing a conventional base station in a cellular communication system.
Figure 2A:
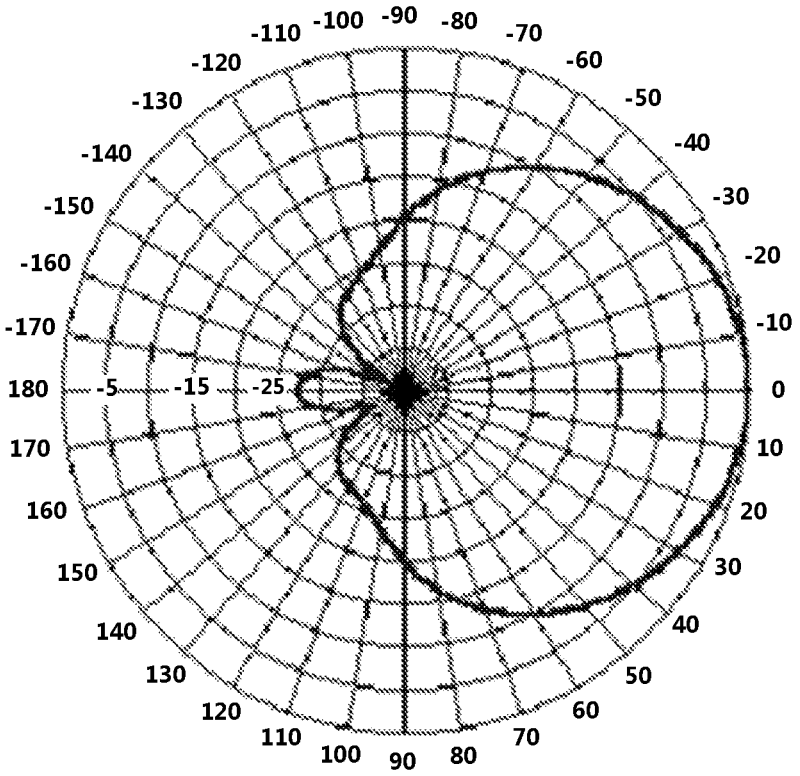
FIG. 2A is an exemplary radiation pattern in the azimuth plane of a sector antenna that is suitable for use in a conventional 3-sector cellular configuration.
Figure 2B:
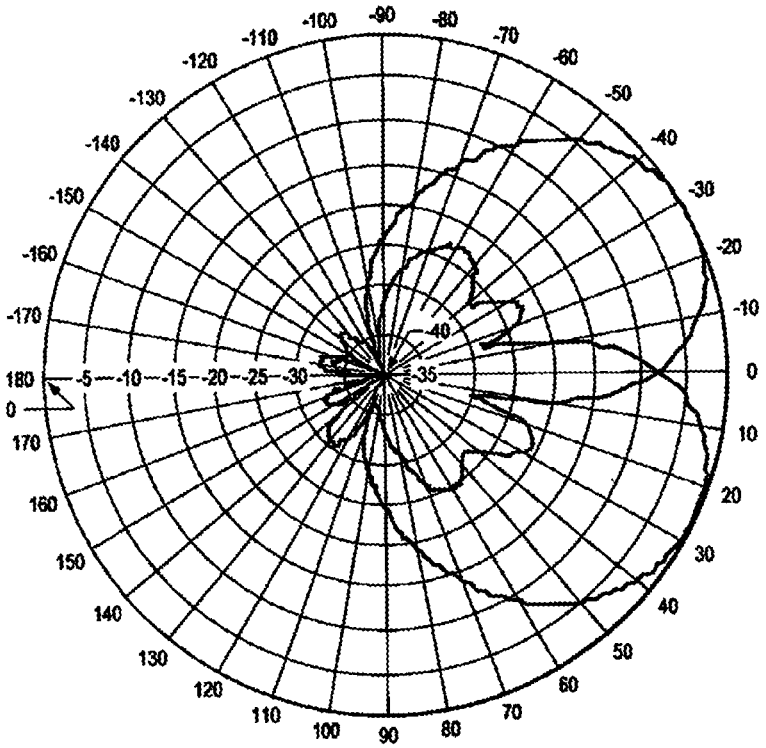
FIG. 2B is an exemplary radiation pattern in the azimuth plane of a dual-beam antenna that is suitable for use in a conventional 6-sector cellular configuration.

Note that, in some cases the same elements or elements having similar functions are denoted by the same reference numerals in different drawings, and description of such elements is not repeated. In some cases, similar reference numerals and letters are used to refer to similar elements, and thus once an element is defined with reference to one figure, it need not be further discussed with reference to subsequent figures.

The position, size, range, or the like of each structure illustrated in the drawings may not be drawn to scale. Thus, the invention is not necessarily limited to the position, size, range, or the like as disclosed in the drawings.

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached" to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

Figure 3A:
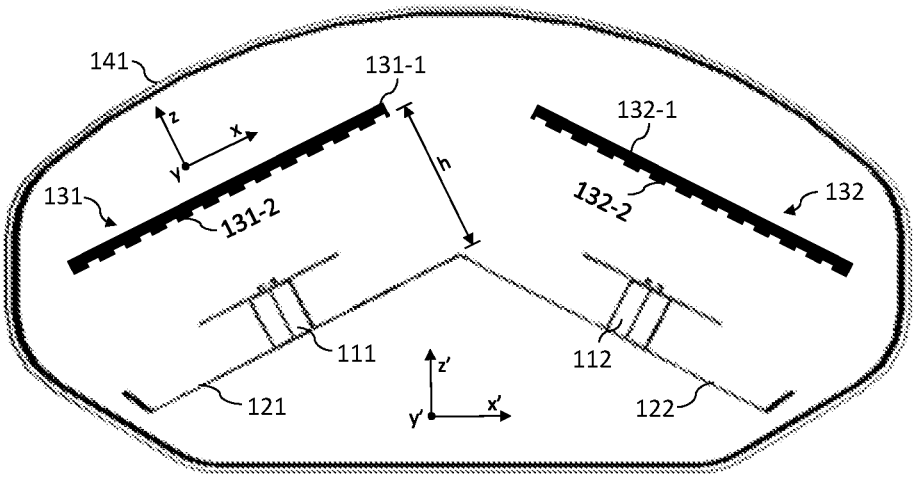
FIG. 3A is a highly simplified horizontal cross-sectional view of a base station antenna according to an embodiment of the present invention.

Herein, reference coordinates used to describe a length, width and thickness of a base station antenna are the Cartesian coordinates with x', y' and z' axes shown in FIG. 3A. The direction of the x' axis is the width direction of a base station antenna, the direction of the y' axis is the length direction of the base station antenna, and the direction of the z' axis is the thickness direction of the base station antenna. Further, the direction of the y' axis is also described as a vertical direction, the plane defined by the x' and z' axes is described as a horizontal plane or a horizontal direction, and the positive direction of the z' axis is described as the outer side of the base station antenna. Reference coordinates used to describe lengths, widths, and thicknesses of the plate assembly 131, the backplane 121, and the array of radiating elements 111 are the Cartesian coordinates with x, y and z axes shown in FIG. 3A. The direction of the x axis is the width direction, the direction of the y axis is the length direction, and the direction of the z axis is the thickness direction of these components. Further, the positive and negative directions of the z axis are described as the outer side and the inner side of these components, respectively. It will be appreciated that reference coordinates used to describe lengths, widths, and thicknesses of the plate assembly 132, the backplane 122, and the array of radiating elements 112 in FIG. 3A are Cartesian coordinates (not shown) that is symmetric with the Cartesian coordinates with x, y and z axes about the plane defined by y' and z' axes; and reference coordinates used to describe lengths, widths, and thicknesses of plate assemblies, the backplanes, and arrays of radiating elements in other figures are similar to the Cartesian coordinates with x, y and z axes shown in FIG. 3A.

According to an embodiment of the present invention, a multi-beam (e.g., dual-beam) base station antenna in which Fabry-Perot cavities are formed is provided.

Base station antennas according to embodiments of the present invention may include first and second arrays of radiating elements that are configured to respectively emit first and second electromagnetic radiation; and first and second backplanes on which the first and second arrays of radiating elements are respectively disposed. The first and second backplanes are positioned with a mechanical tilt relative to each other such that directions in which the first and second electromagnetic radiation are emitted are different in the azimuth plane. The first and second backplanes are configured to reflect inwardly-directed portions of the first and second electromagnetic radiation outwardly, respectively. The base station antenna further includes first and second plate assemblies, each of which is configured to reflect a first portion of its received electromagnetic radiation inwardly while allowing a second portion of the received electromagnetic radiation to pass outwardly therethrough. The first and second plate assemblies are positioned to form, respectively with the first and second backplanes, first and second Fabry-Perot cavities for the first and second electromagnetic radiation, respectively. The first and second plate assemblies are operated as Partially Reflective Surfaces of the respective Fabry-Perot cavities. After the first portion of the received electromagnetic radiation is reflected inwardly by a plate assembly, the first portion of the electromagnetic radiation travels inwardly to the corresponding backplane and is reflected outwardly by the backplane so as to reach the plate assembly again. Portions of the electromagnetic radiation are in-phase in the maximum radiation direction of the electromagnetic radiation, and out-of-phase in other directions. Accordingly, the electromagnetic radiation emitted by the array of radiating elements is gathered (focused) toward the maximum radiation direction so that the beam formed by the electromagnetic radiation is narrowed. Since the plate assembly may be relatively thin (for example, 1 to 2 mm), the base station antennas according to the embodiments of the present invention, as compared to conventional base station antennas having a spherical lens, a hemispherical lens or a cylindrical lens with a circular or semi-circular cross section, may have a reduced size (e.g., thickness) and improved heat dissipation. Since the Fabry-Perot cavity has an effect on focusing electromagnetic radiation, an array of radiating elements that each have, for example, a nominal 65° beamwidth in the azimuth plane may need to include only 2 columns or even 1 column of radiating elements so as to achieve a narrower beamwidth in the azimuth plane (for example, a beamwidth of 33°). Moreover, a conventional non-lensed base station antenna would typically include an array of radiating elements having 3 or 4 columns of radiating elements in order to achieve electromagnetic radiation patterns (also referred to as "antenna beams") having azimuth beamwidths of about 33°. Accordingly, the base station antennas according to embodiments of the present invention may advantageously be smaller in size (e.g., width) as compared to conventional base station antennas with comparable capabilities, and may also advantageously have simplified feed networks. The width and length of each plate assembly may be designed according to requirements. The wider the plate assembly is, the more it narrows the antenna beam in the azimuth plane; and the longer the plate assembly is, the more it narrows the antenna beam in the elevation plane.

In some embodiments, the plate assembly includes a plurality of units that are arranged in an array so as to reflect the first portion of the received electromagnetic radiation inwardly while allowing the second portion to travel outwardly therethrough, where a dimension of each unit is a sub-wavelength of the received electromagnetic radiation. As long as the number of units arranged in the width direction of the plate assembly is more than a specific number, the plate assembly may have a narrowing effect on the antenna beam in the azimuth plane. For example, if the number of units arranged along the width direction of the plate assembly is not less than 10, a significant narrowing effect on the antenna beam may be achieved. The greater the number of units arranged along the width direction, the stronger the narrowing effect on the antenna beam in the azimuth plane may be achieved. The narrowing effect on the antenna beam in the elevation plane is similar to that in the azimuth plane. In the case where the dimension of each unit is a sub-wavelength such as, for example, one tenth of the wavelength, the width of the array in which the plurality of units are arranged is slightly more than one wavelength, which is obviously advantageous for reducing the size (e.g., width) of the base station antenna.

In some embodiments, the plate assembly may be fabricated using a mature manufacturing process such as printed circuit board (PCB) manufacturing technology, which facilitates manufacturing the plate assembly. In some embodiments, the plate assembly may be formed as at least a portion of the radome that houses the one or more arrays of radiating elements, which may facilitate simplifying the configuration and assembly of the base station antenna, further reducing the size of the base station antenna, and which may also improve heat dissipation.

According to further embodiments of the present invention, a multi-band base station antenna in which Fabry-Perot cavities are formed is provided. In one example embodiment of such a base station antenna, first and second arrays of radiating elements are provided that operate in a first frequency band, and third and fourth arrays of radiating elements are provided that operate in a second frequency band that is different than the first frequency band. The first and third arrays extend forwardly from the outer surface of a first backplane. The second and fourth arrays extend forwardly from the outer surface of a second backplane. The base station antenna further includes first and third plate assemblies disposed opposite the first backplane, and second and fourth plate assemblies disposed opposite the second backplane. The first and third plate assemblies respectively receive electromagnetic radiation from the first and third arrays of radiating elements, and respectively form, with the first backplane, first and third Fabry-Perot cavities for electromagnetic radiation from the first and third arrays of radiating elements, respectively. The second and fourth plate assemblies respectively receive electromagnetic radiation from the second and fourth arrays of radiating elements, and respectively form, with the second backplane, second and fourth Fabry-Perot cavities for electromagnetic radiation from the second and fourth arrays of radiating elements, respectively. Since different plate assemblies for respective arrays of radiating elements operating in different frequency bands may be arranged in multiple layers (e.g., two layers), the overall impact of adding the plate assemblies on the size of the base station antenna may be relatively small. Consequently, the multi-band base station antenna according to embodiments of the present invention may be smaller than a comparable conventional base station antenna having a radio frequency lens.

According to an additional embodiment of the present invention, another multi-band base station antenna is provided that includes Fabry-Perot cavities. The base station antenna includes first through third backplanes, where the first and second backplanes are positioned such that an angle between outer surfaces of the first and second backplanes is greater than 180 degrees, and the third backplane is positioned between the first and second backplanes. The first and second arrays of radiating elements extend forwardly from outer surfaces of respective the first and second backplanes. The first and second plate assemblies are respectively positioned to receive electromagnetic radiation from the first and second arrays of radiating elements, and form first and second Fabry-Perot cavities with the first and second backplanes for respective electromagnetic radiation, respectively. A third array of radiating elements whose operation frequency band is different from those of the first and second arrays of radiating elements is extends forwardly from an outer surface of the third backplane, such that the peak emission direction of the electromagnetic radiation of the third array of radiating elements in the azimuth plane is between the peak emission directions of the electromagnetic radiation of the first and second arrays of radiating elements. Since the first and second arrays of radiating elements each include only 2 columns or even 1 column of radiating elements so as to achieve a narrower beam, there may be sufficient space between the first and second arrays of radiating elements to place the third array of radiating elements, even if radiating elements in the third array of radiating elements have relatively large sizes when the array operates in a lower frequency band.

FIG. 3A schematically shows the configuration of a base station antenna according to an embodiment of the present invention. The base station antenna includes first and second arrays of radiating elements 111 and 112 (only a single radiating element of each array is visible in the view of FIG. 3A) that extend forwardly from outer surfaces of respective first and second backplanes 121 and 122. The backplanes 121 and 122 are configured to reflect the electromagnetic radiation from the arrays of radiating elements 111 and 112, respectively. The arrays of radiating elements 111 and 112 each include a plurality of radiating elements that are arranged in a vertical column. The array of radiating elements 111 is configured to emit first electromagnetic radiation to generate a first antenna beam having a first pointing direction in the azimuth plane. The array of radiating elements 112 is configured to emit second electromagnetic radiation to generate a second antenna beam having a second pointing direction in the azimuth plane. The backplanes 121 and 122 are positioned with a mechanical tilt relative to each other such that the first and second pointing directions are different.

In the depicted embodiment, the backplanes 121 and 122 are positioned such that the angle between the outer surface of the backplane 121 and the outer surface of the backplane 122 is greater than 180 degrees. It will be appreciated that since each backplane 121, 122 has a physical thickness, the angle between the outer surfaces of the two backplanes refers to an angle that does not pass through the thickness of either of the backplanes 121, 122. Since the angle between the outer surfaces of the backplanes 121 and 122 is greater than 180 degrees, interference between the electromagnetic radiation from the arrays of radiating elements 111 and 112 may be reduced. It will be appreciated, however, that the backplanes 121 and 122 may be positioned such that the angle between the outer surfaces of the two backplanes is less than 180 degrees, as long as there is a mechanical tilt between the two backplanes and the first and second directions are different. In the depicted embodiment, the base station antenna includes only two backplanes 121 and 122. It will be appreciated that in other cases the base station antenna may include more backplanes with mechanical tilts therebetween. For example, additional backplanes may be provided so that the backplanes are arranged in a cylindrical shape such as, for example, a cylinder having a triangular, rectangular, or other polygonal horizontal cross section.

In the depicted embodiment, each of the arrays of radiating elements 111 and 112 includes a column of radiating elements. However, in some embodiments, each of the arrays of radiating elements 111 and 112 may include more than one column of radiating elements. In the depicted embodiment, the radiating elements in the first array of radiating elements 111 and the radiating elements in the second array of radiating elements 112 may be identical to each other. It will be appreciated that radiating elements in the respective first and second arrays may be different in other embodiments. In the depicted embodiment, the radiating elements in the first array 111 and the radiating elements in the second array 112 are each arranged in a single respective column to form first and second vertically-extending linear arrays 111, 112. However, it will be appreciated that the radiating elements forming the respective first and second arrays 111, 112 may be disposed on their corresponding backplanes in any known pattern; for example, the plurality of radiating elements in a column may be staggered in the horizontal direction. In the depicted embodiment, the radiating elements in the two arrays are crossed dipole radiating elements. It will be appreciated that each of the arrays may use other suitable radiating elements including, for example, dipoles, slot radiating elements, horn waveguides, patch radiating elements, or the like.

The base station antenna further includes plate assemblies 131 and 132. The plate assemblies 131 and 132 are configured to reflect a first portion of their received electromagnetic radiation inwardly and to allow a second portion of the received electromagnetic radiation to pass therethrough. In the depicted embodiment, the plate assembly 131 includes a substrate 131-1 and a plurality of units 131-2 arranged in an array that are disposed on an inner surface of the substrate 131-1. The dimension of each unit 131-2 is a sub-wavelength of the electromagnetic radiation that is emitted by the first array of radiating elements 111, such that the plate assembly 131 may reflect the first portion of the electromagnetic radiation received from the first array 111 inwardly while allowing the second portion of the received electromagnetic radiation to pass outwardly through the plate assembly 131. The plate assembly 131 is positioned to form a first Fabry-Perot cavity with the backplane 121. The first Fabry-Perot cavity is for the electromagnetic radiation from the first array of radiating elements 111. The plate assembly 132 includes a substrate 132-1 and a plurality of units 132-2 arranged in an array that are disposed on an inner surface of the substrate 132-1. The dimension of each unit 132-2 is a sub-wavelength of the electromagnetic radiation that is emitted by the second array of radiating elements 112, such that the plate assembly 132 may reflect the first portion of the electromagnetic radiation received from the second array 112 inwardly while allowing the second portion of the received electromagnetic radiation to pass outwardly through the plate assembly 132. The plate assembly 132 is positioned to form a second Fabry-Perot cavity with the backplane 122. The second Fabry-Perot cavity is for electromagnetic radiation from the second array of radiating elements 112.

The dimension of the units 131-2 or 132-2 refers to a dimension of the units 131-2 or 132-2 in at least one direction in a plan view that is parallel to the main surface of the respective plate assembly 131 or 132. The sub-wavelength of electromagnetic radiation refers to a wavelength that is equal to or less than the wavelength corresponding to the center frequency of the emitted electromagnetic radiation. In the depicted embodiment, the array in which the plurality of units 131-2 are arranged and the array in which the plurality of units 132-2 are arranged are disposed on the inner surfaces of the substrates 131-1 and 132-1, respectively. However, it will be appreciated that the two arrays may both be disposed on the outer surfaces of the respective substrates 131-1 and 132-1, or one may be disposed on the inner surface of the corresponding substrate and the other disposed on the outer surface of the corresponding substrate. In other embodiments, the arrays may be arranged within interiors of the respective substrates 131-1, 132-1. In still other embodiments, although not shown in the drawings, the plurality of units arranged in an array may not be disposed on either surface of the substrate. For example, the substrate may be formed of a conductive material and the plurality of units may be a plurality of apertures arranged in an array that are formed in the substrate.

In some embodiments, in the length directions of the plate assemblies 131 and 132, the dimensions of the arrays, in which the plurality of units are arranged, may be slightly smaller than, substantially equal to, or larger (maybe slightly) than the lengths of respective arrays of radiating elements 111 and 112. In some embodiments, in the width directions of the plate assemblies 131 and 132, the dimensions of the arrays, in which the plurality of units are arranged, may be slightly smaller than, substantially equal to, or larger (maybe slightly) than the widths of respective backplanes 121 and 122. In some embodiments, in the width direction of the plate assemblies 131 and 132, the dimensions of the arrays, in which the plurality of units are arranged, may be related to the widths of respective arrays of radiating elements 111 and 112, for example, the widths of the arrays of units may be 5-8 times the widths of the respective arrays of radiating elements 111 and 112.

The plate assemblies 131 and 132 are positioned substantially parallel to and spaced apart from the respective backplanes 121 and 122 by a specific distance h so as to form respective Fabry-Perot cavities. According to the resonant condition of a Fabry-Perot cavity, the distance h between a plate assembly and a corresponding backplane is determined by:

$$h=(\varphi_1+\varphi_2-N2\pi)\lambda/4\pi \qquad \text{Equation (1)}$$

In Equation (1), $\varphi_1$ denotes the reflection phase of the backplane with respect to the electromagnetic radiation, $\varphi_2$ denotes the reflection phase of the plate assembly with respect to the electromagnetic radiation, $\lambda$ is the wavelength of the electromagnetic radiation, and N is a non-negative integer, i.e., N=0, 1, 2, . . . .

Figure 4A:
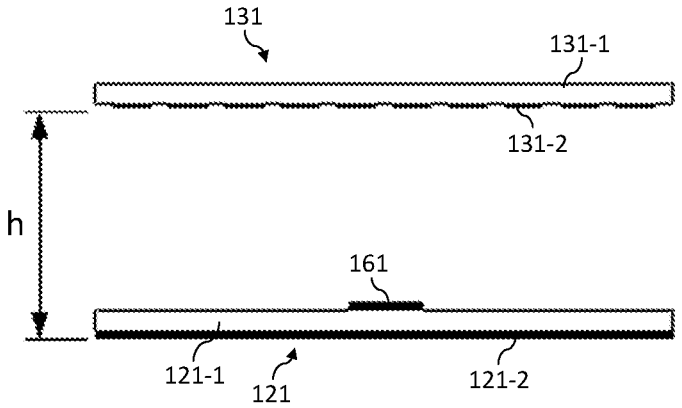
FIGS. 4A and 4B are schematic diagrams of distances between plate assemblies and backplanes in base station antennas according to some embodiments of the present invention.
Figure 4B:
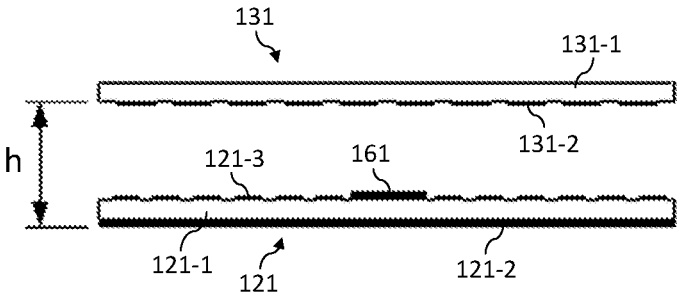
Figure 5A:
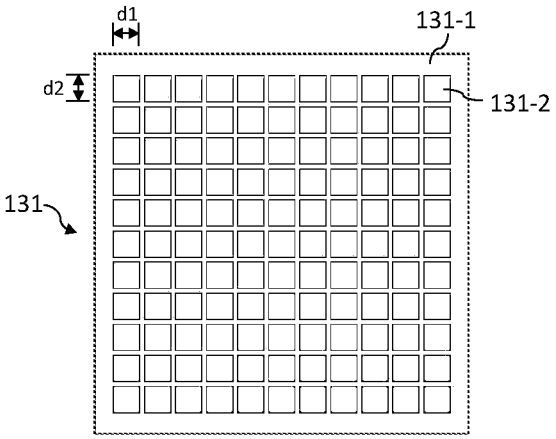
FIGS. 5A through 5G are plan views of plate assemblies in base station antennas according to some embodiments of the present invention.
Figure 5B:
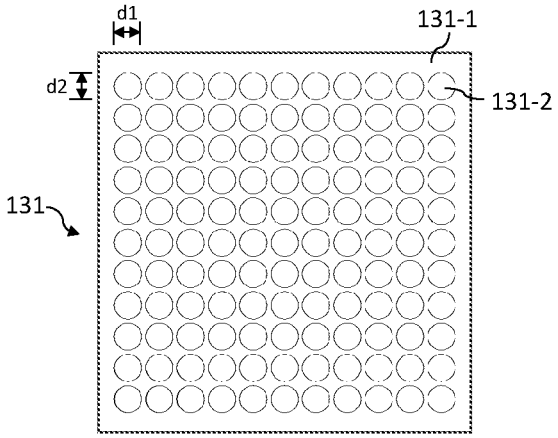
Figure 5C:
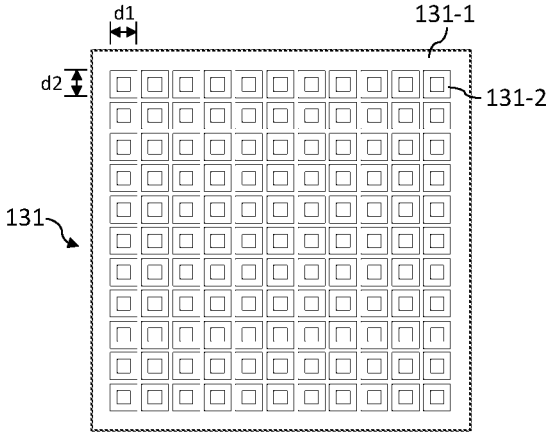
Figure 5D:
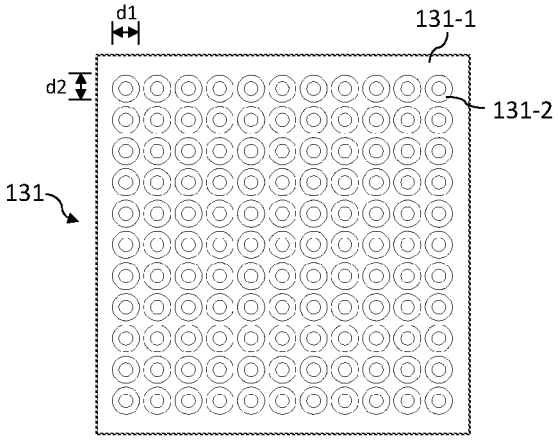
Figure 5E:
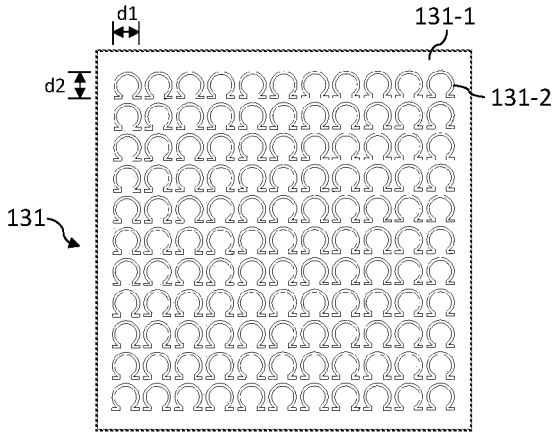
Figure 5F:
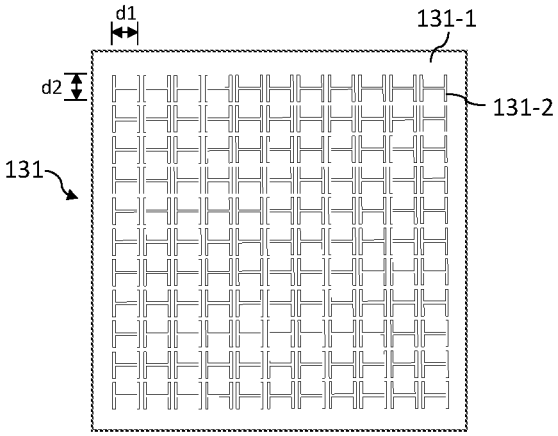
Figure 5G:
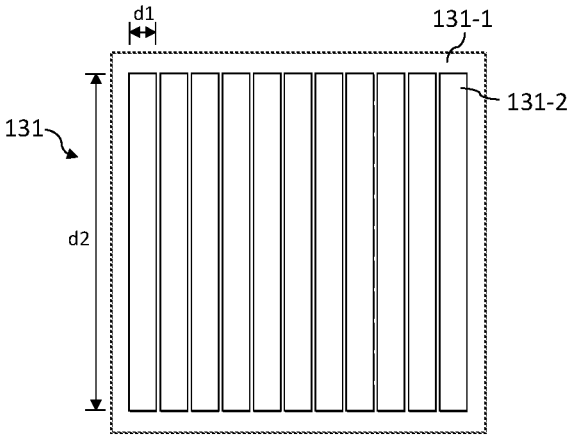

The distance h between the plate assembly and the corresponding backplane will be described below in connection with FIGS. 4A and 4B and taking the plate assembly 131 and the backplane 121 for example. As shown in FIG. 4A, in some embodiments, the backplane 121 includes a dielectric substrate 121-1 and a conductor ground plane 121-2 formed on an inner surface of the dielectric substrate 121-1. A patch radiating element 161 is disposed on an outer surface of the dielectric substrate 121-1. The plate assembly 131 includes a substrate 131-1 formed of a dielectric material and a plurality of conductor units 131-2 arranged in an array on an inner surface of the substrate 131-1. A dimension of the conductor unit 131-2 is a sub-wavelength of electromagnetic radiation that is emitted by the patch radiating element 161. The reflection phase of the backplane 121 (for example, the conductor ground plane 121-2 having a reflection function included in the backplane 121) with respect to the electromagnetic radiation that is emitted by the patch radiating element 161 is $\pi$, the reflection phase of the plate assembly 131 (for example, the array in which the plurality of conductor units 131-2 are arranged having a reflection function included in the plate assembly 131) with respect to the electromagnetic radiation that is emitted by the patch radiating element 161 is also $\pi$, that is, $\varphi_1=\varphi_2=\pi$ in the Equation (1). Then, according to Equation (1), the distance h between the plate assembly 131 and the backplane 121 when satisfying the resonant condition of the Fabry-Perot cavity is calculated to be $N\lambda/2$. Therefore, in these embodiments, the plate assembly 131 is positioned such that the distance h between the plate assembly 131 and the backplane 121 (for example, the array in which the plurality of conductor units 131-2 are arranged and the conductor ground plane 121-2) is substantially an integer multiple of a half wavelength of the electromagnetic radiation emitted by the patch radiating element 161.

Changing nature of the surface having the reflection function in the backplane affects the reflection phase of the backplane with respect to the electromagnetic radiation, that is, making $\varphi_1\neq\pi$ so that the distance h between the plate assembly and the backplane when satisfying the resonant condition of the Fabry-Perot cavity changes. As shown in FIG. 4B, in some embodiments, the backplane 121 includes a dielectric substrate 121-1, a conductor ground plane 121-2 that is formed on an inner surface of the dielectric substrate 121-1, and a plurality of conductor units 121-3 arranged in an array that are disposed on an outer surface of the dielectric substrate 121-1. A dimension of the conductor unit 121-3 is a sub-wavelength of the electromagnetic radiation that is emitted by the patch radiating element 161. The reflection phase of the backplane 121 (for example, the array in which the plurality of conductor units 121-3 are arranged and the conductor ground plane 121-2 having reflection functions included in the backplane 121) with respect to the electromagnetic radiation that is emitted by the patch radiating element 161 is zero, the reflection phase of the plate assembly 131 (for example, the array in which the plurality of conductor units 131-2 are arranged having a reflection function included in the plate assembly 131) with respect to the electromagnetic radiation that is emitted by the patch radiating element 161 is still $\pi$, that is, $\varphi_1=0$ and $\varphi_2=\pi$ in the Equation (1). Then, according to Equation (1), the distance h between the plate assembly 131 and the backplane 121 when satisfying the resonant condition of the Fabry-Perot cavity is calculated to be $N\lambda/4$. Therefore, in these embodiments, the plate assembly 131 is positioned such that the distance h between the plate assembly 131 and the backplane 121 (for example, the array in which the plurality of conductor units 131-2 are arranged and the conductor ground plane 121-2) is substantially an integer multiple of a quarter wavelength of the electromagnetic radiation from the radiating element 161.

In the depicted embodiment, the radiating element 161 is a patch radiating element, the array in which the plurality of conductor units 131-2 are arranged is disposed on the inner surface of the substrate 131-1, and the conductor ground plane 121-2 is disposed on the outer surface of the dielectric substrate 121-1. However, it will be appreciated that the radiating element 161 may be any suitable radiating element, the array in which the plurality of conductor units 131-2 are arranged may be disposed on either surface of the substrate 131-1, and the conductor ground plane 121-2 may be disposed on either surface of the dielectric substrate 121-1.

Figure 6A:
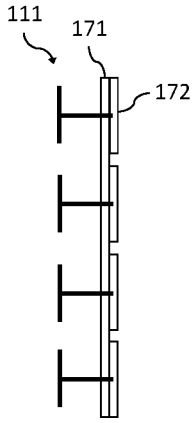
FIGS. 6A through 6F are schematic views of backplanes in base station antennas according to some embodiments of the present invention, in which arrays of radiating elements are shown.
Figure 6B:
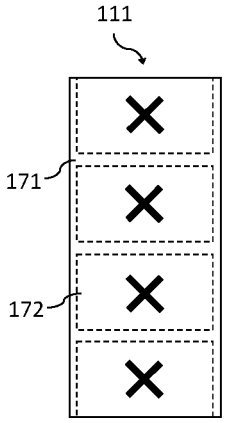

FIGS. 6A through 6F schematically illustrate backplanes in base station antennas according to some embodiments of the present invention, where arrays of radiating elements 111 are disposed on outer surfaces of backplanes. FIGS. 6A and 6B are highly simplified side view and front view, respectively, of a backplane in a base station antenna according to an embodiment of the present invention. In this embodiment, feed boards 172 for feeding radiating elements are disposed inside a reflector 171. The radiating element may be mounted on the feed board 172 through a hole formed in the reflector 171. A plurality of feed boards 172 may be provided, each of which may feed a row of radiating elements in the array 111. Although each row includes only one radiating element in the depicted embodiment, it will be appreciated that each row may include more radiating elements. In this embodiment, the backplane 121 that forms the Fabry-Perot cavity with the plate assembly 131 may be the reflector 171.

Figure 6C:
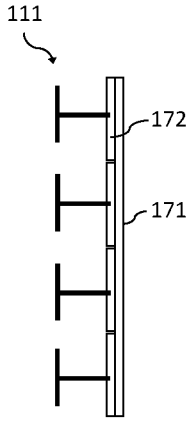
Figure 6D:
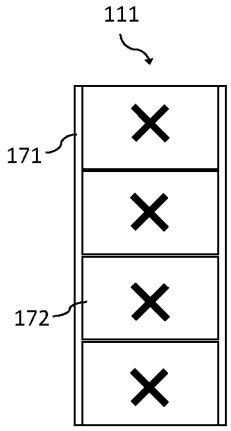

FIGS. 6C and 6D are highly simplified side view and front view, respectively, of a backplane in a base station antenna according to another embodiment of the present invention. In this embodiment, feed boards 172 for feeding radiating elements are disposed outside a reflector 171. The radiating element is mounted on the feed board 172. A plurality of feed boards 172 may be provided, each of which may feed a row of radiating elements in the array 111. In this embodiment, the backplane 121 that forms the Fabry-Perot cavity with the plate assembly 131 may be the plurality of feed boards 172, wherein the conductor plane that is disposed on the inner surface of the backplane 121 may be the whole of ground planes that are respectively disposed on the inner surfaces of the plurality of feed boards 172. The size of the gap between adjacent feed boards 172 may be configured to be much smaller than the wavelength of the electromagnetic radiation of the radiating elements so as to avoid the electromagnetic radiation passing through the gap.

Figure 6E:
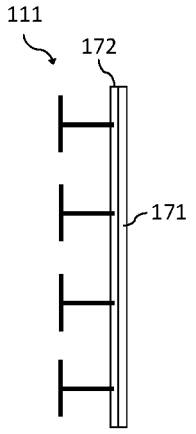
Figure 6F:
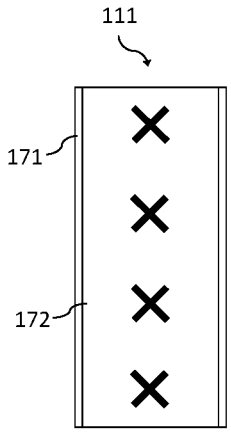

FIGS. 6E and 6F are highly simplified side view and front view, respectively, of a backplane in a base station antenna according to another embodiment of the present invention. In this embodiment, a feed board 172 for feeding radiating elements is disposed outside a reflector 171. The radiating elements are mounted on the feed board 172. In this embodiment, a single feed plate 172 feeds each radiating elements in the array 111. In this embodiment, the backplane 121 that forms the Fabry-Perot cavity with the plate assembly 131 may be the feed board 172, wherein the conductor plane that is disposed on the inner surface of the backplane 121 may be the ground plane that is disposed on the inner surface of the feed board 172. This is easier to be implemented in the case where the array 111 operates in a higher frequency band, because the dimensions of the radiating element and the feed board 172 (usually implemented by a printed circuit board PCB) are relatively small when the operating frequency band of the array 111 is higher. Therefore, it is easier to feed all of the radiating elements in the array 111 by a single feed board 172.

In the embodiment depicted in FIG. 3A, the distance between the plate assembly 131 and the backplane 121 is substantially equal to the distance between the plate assembly 132 and the backplane 122. However, it will be appreciated that the two distances may be unequal, and either may be designed according to actual requirements. The base station antenna further includes a radome 141 that houses the first and second arrays of radiating elements 111 and 112. At least one of the plate assemblies 131 and 132 may be formed as at least a portion of the radome 141.

FIGS. 5A through 5G are plan views schematically showing example implementations of the plate assembly 131 in base station antennas according to some embodiments of the present invention. In some embodiments, the substrate 131-1 of the plate assembly 131 is formed of a dielectric material, and the plurality of units 131-2 arranged in an array are formed of a conductive material on a surface of the substrate 131-1. In some embodiments, the substrate 131-1 of the plate assembly 131 is formed of a conductive material, and the plurality of units 131-2 arranged in an array are apertures formed in the substrate 131-1. Each of the units 131-2 shown in each of FIGS. 5A through 5G may be the above-described conductive material formed on a surface of the dielectric material substrate 131-1, or may be the above-described apertures formed in the conductive material substrate 131-1. For example, in FIG. 5A, each unit 131-2 is rectangular, which may be either a solid conductor or a hollow aperture. The shape of each unit 131-2 is not limited to those shown in the drawings, as long as the dimension of the unit 131-2 is a sub-wavelength, and the plurality of units 131-2 are arranged in an array to form a periodic structure. For example, the unit 131-2 may be a solid shape (such as the shape shown in FIG. 5A or 5B), a hollow shape (such as the shape shown in FIG. 5C or 5D), a stripe (such as the shape shown in FIG. 5G), an unclosed shape (such as the shape shown in FIG. 5E), an irregular shape (such as the shape shown in FIG. 5F), or the like.

In some embodiments, the dimension of the unit is equal to about one tenth of the wavelength of the electromagnetic radiation received by the plate assembly. The dimension of the unit refers to the dimension of the unit along at least one direction (including but not limited to the length direction, width direction, diagonal direction, etc. of the plate assembly) in a plan view that is parallel to the main surface of the plate assembly. It will be appreciated that in other embodiments, the dimension of the unit may be smaller than one tenth of the wavelength, but smaller dimension always causes higher cost. In some embodiments, the number of units arranged in an array is greater than or equal to 10 along at least one direction in the plan view. FIGS. 5A through 5G also show dimensions d1 and d2 of the unit 131-2 in first and second directions (e.g., a width direction and a length direction) of the plate assembly 131. In the example shown in FIG. 5G, a plurality of units 132-2 are arranged along the first direction of the plate assembly 131, and only one unit 132-2 is arranged along the second direction. Therefore, the plate assembly 131 may achieve the effect on narrowing the beam in the first direction, but may not achieve the effect on narrowing the beam in the second direction. In the case where the first direction is the width direction, the plate assembly 131 shown in FIG. 5G may focus the electromagnetic radiation in the azimuth plane. In the case where the first direction is the length direction, the plate assembly 131 shown in FIG. 5G may focus the electromagnetic radiation in the elevation plane.

Figure 3B:
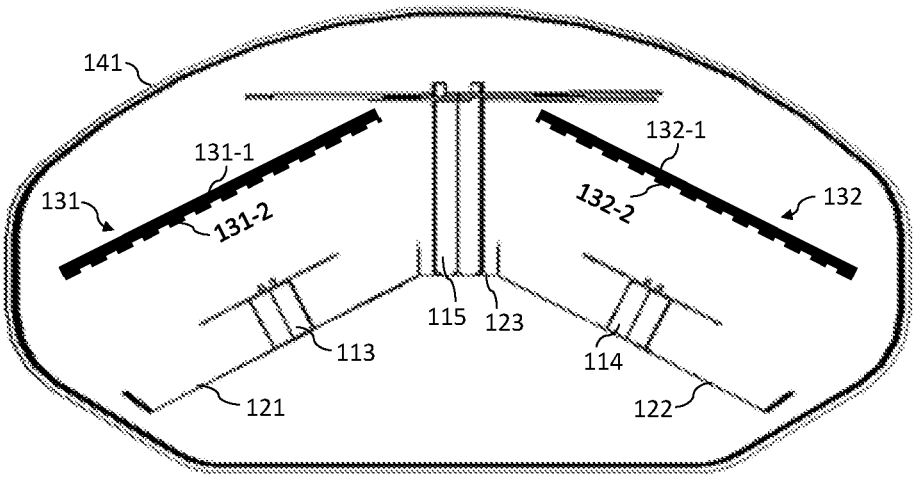
FIG. 3B is a highly simplified horizontal cross-sectional view of a base station antenna according to a further embodiment of the present invention.

FIG. 3B schematically shows a configuration of a base station antenna according to a further embodiment of the present invention. The base station antenna includes arrays of radiating elements 113 through 115 which are respectively disposed on and extend forwardly from outer surfaces of the respective backplanes 121 through 123. The backplanes 121 and 122 are configured to respectively reflect the electromagnetic radiation from the arrays of radiating elements 113 and 114 outwardly. Each of the arrays of radiating elements 113 through 115 includes a column of radiating elements. The array of radiating elements 113 is configured to emit first electromagnetic radiation within all or a portion of a first frequency band (e.g., 1710~2690 MHz band and/or 3300~6000 MHz band), the array of radiating elements 114 is configured to emit second electromagnetic radiation within all or a portion of the first frequency band as well, and the array of radiating elements 115 is configured to emit third electromagnetic radiation within all or a portion of a second frequency band (e.g., 694~960 MHz band) that is different from the first frequency band. In the depicted embodiment, the second frequency band is lower than the first frequency band such that sizes of radiating elements in the array 115 are larger than sizes of radiating elements in the arrays 113 and 114. The base station antenna further includes plate assemblies 131 and 132, and a radome 141 that houses the arrays of radiating elements 113 through 115. Since each of the plate assemblies 131 and 132 may be similar to that described above, duplicate descriptions will be omitted. In some embodiments, at least one of the plate assemblies 131 and 132 may be formed as at least a portion of the radome 141.

The backplanes 121 and 122 are positioned with a mechanical tilt relative to each other such that the directions in which the first and second electromagnetic radiation are emitted are different. The backplane 123 is positioned between the backplanes 121 and 122. Two vertical sides of the backplane 123 are mechanically coupled to respective sides of the backplanes 121 and 122, respectively. The backplane 123 is oriented substantially along the width direction of the base station antenna, and the angle between the outer surface of the backplane 121 and the outer surface of the backplane 123 is substantially equal to the angle between the outer surface of the backplane 122 and the outer surface of the backplane 123. Thus, in the azimuth plane, the direction of the third electromagnetic radiation may be about midway between the directions of the first and second electromagnetic radiation.

In the depicted embodiment, since the second frequency band in which the array of radiating elements 115 operates is lower than the first frequency band in which the arrays of radiating elements 113 and 114 operate, the radiating elements in the array of radiating elements 115 are larger than the radiating elements in the arrays of radiating elements 113 and 114. The distance from the radiating arms (or surfaces, apertures, etc.) of the radiating elements in the array of radiating elements 115 to the outer surface of the backplane 123 is greater than the distances of the plate assemblies 131 and 132 to the outer surfaces of the respective backplanes 121 and 122. That is, the radiating arms of each radiating element in the array of radiating elements 115 are located on outer sides of the plate assemblies 131 and 132. This configuration may prevent the plate assemblies 131 and 132 from receiving electromagnetic radiation from the array of radiating elements 115. In the depicted embodiment, each of the arrays of radiating elements 113 through 115 includes only one column of radiating elements. However, it will be appreciated that each array may include more columns of radiating elements in other embodiments.

Figure 3C:
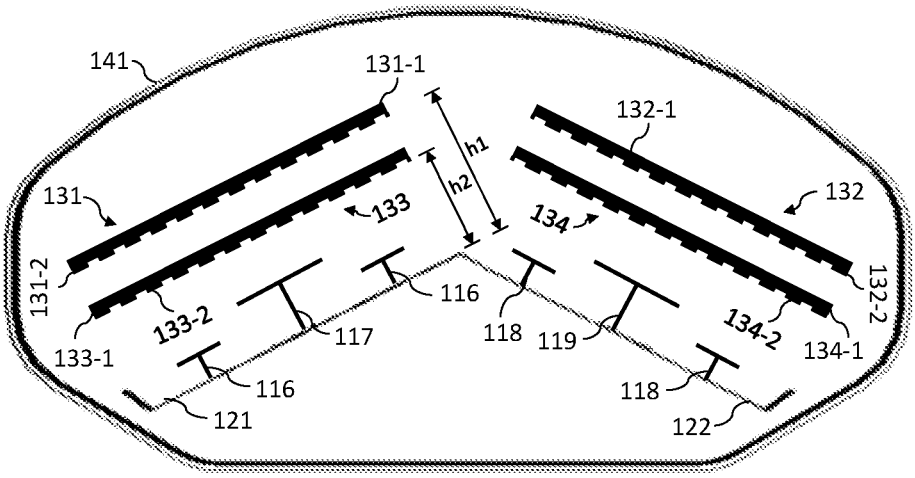
FIG. 3C is a highly simplified horizontal cross-sectional view of a base station antenna according to a further embodiment of the present invention.

FIG. 3C schematically shows a configuration of a base station antenna according to a further embodiment of the present invention. The base station antenna includes arrays of radiating elements 116 through 119. The arrays of radiating elements 116 and 117 are disposed on an outer surface of the backplane 121, and the arrays of radiating elements 118 and 119 are disposed on an outer surface of the backplane 122. The backplane 121 is configured to reflect the electromagnetic radiation from the arrays of radiating elements 116 and 117 outwardly, and the backplane 122 is configured to reflect the electromagnetic radiation from the arrays of radiating elements 118 and 119 outwardly. In the depicted embodiment, the array 116 includes two columns of radiating elements and the array 117 includes one column of radiating elements. The one column of radiating elements in array 117 is disposed between the two columns of radiating elements in array 116, such that the arrays of radiating elements 116 and 117 are interdigitated on the outer surface of the backplane 121. The array 118 includes two columns of radiating elements and the array 119 includes one column of radiating elements. The one column of radiating elements in array 119 is disposed between the two columns of radiating elements in array 118, such that the arrays of radiating elements 118 and 119 are interdigitated on the outer surface of the backplane 122. It will be appreciated, however, that each array of radiating elements may include any suitable number of columns of radiating elements, and the arrangement of the two arrays that are disposed on the same backplane may be designed as needed. The arrays of radiating elements 116 and 118 are configured to operate in all or a portion of a first frequency band (e.g., 1710~2690 MHz band and/or 3300~6000 MHz band), and the arrays of radiating elements 117 and 119 are configured to operate in all or a portion of a second frequency band (e.g., 694~960 MHz band). In the depicted embodiment, the second frequency band is lower than the first frequency band such that the radiating elements in the arrays 117 and 119 are larger than the radiating elements in the arrays 116 and 118. It will be appreciated, however, that the second frequency band may be higher than the first frequency band such that the radiating elements in the arrays 117 and 119 may be smaller than the radiating elements in the arrays 116 and 118 in other embodiments.

The base station antenna further includes plate assemblies 131 through 134. The plate assemblies 131 through 134 are each configured to reflect a first portion of received electromagnetic radiation inwardly and to pass a second portion of the received electromagnetic radiation outwardly through the respective plate assemblies. In the depicted embodiment, the plate assembly 131 includes a substrate 131-1 and a plurality of units 131-2 arranged in an array that are disposed on an inner surface of the substrate 131-1, and the plate assembly 133 includes a substrate 133-1 and a plurality of units 133-2 arranged in an array that are disposed on an inner surface of the substrate 133-1. The plate assembly 132 includes a substrate 132-1 and a plurality of units 132-2 arranged in an array that are disposed on an inner surface of the substrate 132-1, and the plate assembly 134 includes a substrate 134-1 and a plurality of units 134-2 arranged in an array that are disposed on an inner surface of the substrate 134-1.

The plate assemblies 131 and 133 are each substantially parallel to the backplane 121 and are positioned at respective distances h1 and h2 from the backplane 121, such that the plate assemblies 131 and 133 and the backplane 121 form Fabry-Perot cavities for the electromagnetic radiation emitted by the respective arrays of radiating elements 116 and 117. For example, the plate assembly 131 and the backplane 121 may form a first Fabry-Perot cavity for electromagnetic radiation emitted by the array of radiating elements 116, where the distance h1 between the plate assembly 131 and the backplane 121, and the dimension of the unit 131-2 are both related to the wavelength of the electromagnetic radiation emitted by the array of radiating elements 116. The plate assembly 133 and the backplane 121 may form a second Fabry-Perot cavity for electromagnetic radiation emitted by the array of radiating elements 117, where the distance h2 between the plate assembly 133 and the backplane 121, and the dimension of the unit 133-2 are both related to the wavelength of the electromagnetic radiation emitted by the array of radiating elements 117. It will be appreciated that the plate assembly 131 may be used for the array of radiating elements 117, where the distance h1 and the dimension of the unit 131-2 may be related to the wavelength of the electromagnetic radiation emitted by the array of radiating elements 117; and the plate assembly 133 may be used for the array of radiating elements 116, where the distance h2 and the dimension of the unit 133-2 may be related to the wavelength of the electromagnetic radiation emitted by the array of radiating elements 116. Similarly, the plate assemblies 132 and 134 are each substantially parallel to backplane 122 and are positioned to form, with the backplane 122, Fabry-Pero cavities for the electromagnetic radiation emitted by the respective arrays of radiating elements 118 and 119.

The arrays of radiating elements 116 and 117 are interdigitated on the outer surface of the backplane 121, and therefore, the plate assemblies 131 and 133 that are configured to respectively receive the electromagnetic radiation from the arrays of radiating elements 116 and 117 are parallel to and overlap each other in a plan view parallel to the main surface of one of the plate assemblies 131 and 133. The arrays of radiating elements 118 and 119 are interdigitated on the outer surface of the backplane 122, and therefore, the plate assemblies 132 and 134 that are configured to respectively receive the electromagnetic radiation from the arrays of radiating elements 118 and 119 are parallel to and overlap each other in a plan view parallel to the main surface of one of the plate assemblies 132 and 134.

The base station antenna further includes a radome 141 that houses the arrays of radiating elements 116 through 119. At least one of the plate assemblies 131 through 134 may be formed as at least a portion of the radome 141. In some embodiments, at least a portion of the radome 141 has a multi-layered structure, e.g., a structure with at least two layers that are parallel to each other. For example, the plate assembly 131 is formed as a first layer in the multi-layered structure of the at least a portion of the radome 141, and the plate assembly 133 is formed as a second layer in the multi-layered structure.

In addition, the base station antenna may further include other conventional components not shown in FIGS. 3A through 3C, such as a reflector assembly and a plurality of circuit components and other structures mounted therein. These circuit components and other structures may include, for example, phase shifters for one or more arrays of radiating elements, remote electronic tilt (RET) actuators for mechanically adjusting the phase shifters, one or more controllers, cable connections, RF transmission lines, etc. A mounting bracket (not shown) may also be provided for mounting the base station antenna to another structure, such as an antenna tower or utility pole.

Embodiments are described herein primarily with respect to operations of base station antennas in a transmitting mode in which an array of radiating elements emits electromagnetic radiation. It will be appreciated that base station antennas according to embodiments of the present invention may operate in a transmitting mode and/or a receiving mode in which an array of radiating elements receives electromagnetic radiation. The plate assemblies and backplanes described herein may form Fabry-Perot cavities for such received electromagnetic radiation in order to narrow the beamwidth of the antenna beam for received electromagnetic radiation.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

That which is claimed is:

1. A base station antenna comprising:

a first array of radiating elements that is configured to emit first electromagnetic radiation;

a second array of radiating elements that is configured to emit second electromagnetic radiation;

a first backplane, the first array of radiating elements extending outwardly from an outer surface of the first backplane, and the first backplane being configured to reflect the first electromagnetic radiation outwardly;

a second backplane, the second array of radiating elements extending outwardly from an outer surface of the second backplane, and the second backplane being configured to reflect the second electromagnetic radiation outwardly, wherein the first and second backplanes are positioned with a mechanical tilt relative to each other such that a direction of the first electromagnetic radiation is different from a direction of the second electromagnetic radiation in an azimuth plane;

a first plate assembly configured to reflect a first portion of received electromagnetic radiation inwardly while allowing a second portion of the received electromagnetic radiation to pass outwardly through the first plate assembly, the first plate assembly being positioned to form, with the first backplane, a first Fabry-Perot cavity for the first electromagnetic radiation; and a second plate assembly configured to reflect a first portion of received electromagnetic radiation inwardly while allowing a second portion of the received electromagnetic radiation to pass outwardly through the second plate assembly, the second plate assembly being positioned to form, with the second backplane, a second Fabry-Perot cavity for the second electromagnetic radiation.

2. The base station antenna according to claim 1 wherein the first backplane comprises a first conductor; and the first plate assembly is positioned substantially parallel to the first conductor plane, wherein a distance between the first plate assembly and the first conductor plane is substantially an integer multiple of a half wavelength of the first electromagnetic radiation.

3. The base station antenna according to claim 1 wherein the first backplane comprises a first conductor plane that is disposed on an inner surface of the first backplane so as to reflect the first electromagnetic radiation outwardly, and a partially reflective surface that is disposed on an outer surface of the first backplane, the partially reflective surface being configured to reflect a first portion of received electromagnetic radiation outwardly and make a second portion of the received electromagnetic radiation travel inwardly through the partially reflective surface; and the first plate assembly is positioned substantially parallel to the first conductor plane, and a distance between the first plate assembly and the first conductor plane is substantially an integer multiple of a quarter wavelength of the first electromagnetic radiation.

4. The base station antenna according to claim 3, wherein the partially reflective surface comprises a plurality of conductor units that are arranged in an array, a dimension of each conductor unit being a sub-wavelength of the first electromagnetic radiation.

5. The base station antenna according to claim 1, wherein the first plate assembly comprises a plurality of first units that are arranged in an array so as to reflect the first portion of the received electromagnetic radiation inwardly while allowing the second portion to pass outwardly through the first plate assembly, a dimension of each first unit being a sub-wavelength of the first electromagnetic radiation.

6. The base station antenna according to claim 5, wherein the first plate assembly comprises a first substrate that is formed of dielectric material, and each first unit comprises a respective conductor that is formed on a surface of the first substrate.

7. The base station antenna according to claim 6, wherein the first substrate is a dielectric substrate of a printed circuit board, and the first unit is a conductor printed on a surface of the printed circuit board.

8. The base station antenna according to claim 5, wherein the first plate assembly comprises a first substrate that is formed of conductive material, and the first units are apertures that are formed in the first substrate.

9. The base station antenna according to claim 5, wherein a dimension of each first unit is substantially equal to one tenth of a wavelength corresponding to the center frequency of the first electromagnetic radiation.

10. The base station antenna according to claim 5, wherein the number of first units is greater than or equal to 10 along a width direction of the first plate assembly.

11. The base station antenna according to claim 5, wherein a length of the array in which the plurality of the first units are arranged is greater than or equal to a length of the first array of radiating elements.

12. The base station antenna according to claim 5, wherein a width of the array in which the plurality of the first units are arranged is substantially equal to a width of the first backplane.

13. The base station antenna according to claim 1, further comprising:

a third array of radiating elements that is configured to emit third electromagnetic radiation, the third array of radiating elements being disposed on the outer surface of the first backplane, and the first backplane being further configured to reflect the third electromagnetic radiation outwardly, wherein a frequency band of the third electromagnetic radiation is different from a frequency band of the first electromagnetic radiation;

a fourth array of radiating elements that is configured to emit fourth electromagnetic radiation, the fourth array of radiating elements being disposed on the outer surface of the second backplane, and the second backplane being further configured to reflect the fourth electromagnetic radiation outwardly, wherein a frequency band of the fourth electromagnetic radiation is different from a frequency band of the second electromagnetic radiation;

a third plate assembly that is configured to reflect a first portion of received electromagnetic radiation inwardly while allowing a second portion of the received electromagnetic radiation to pass outwardly through the third plate assembly, the third plate assembly being positioned to form, with the first backplane, a third Fabry-Perot cavity for the third electromagnetic radiation; and a fourth plate assembly that is configured to reflect a first portion of received electromagnetic radiation inwardly while allowing a second portion of the received electromagnetic radiation to pass outwardly through the fourth plate assembly, the fourth plate assembly being positioned to form, with the second backplane, a fourth Fabry-Perot cavity for the fourth electromagnetic radiation.

14. The base station antenna according to claim 13, wherein the first backplane comprises a first conductor plane so as to reflect the first and third electromagnetic radiation outwardly;

the first plate assembly is positioned substantially parallel to the first conductor plane, and a distance between the first plate assembly and the first conductor plane is substantially an integer multiple of a half wavelength of the first electromagnetic radiation; and the third plate assembly is positioned substantially parallel to the first conductor plane, and a distance between the third plate assembly and the first conductor plane is substantially an integer multiple of a half wavelength of the third electromagnetic radiation.

15. The base station antenna according to claim 13, wherein the first backplane comprises a first conductor plane that is disposed on an inner surface of the first backplane so as to reflect the first and third electromagnetic radiation outwardly, and a partially reflective surface that is disposed on an outer surface of the first backplane, the partially reflective surface being configured to reflect a first portion of received electromagnetic radiation outwardly while allowing a second portion of the received electromagnetic radiation to pass inwardly through the partially reflective surface;

the first plate assembly is positioned substantially parallel to the first conductor plane, and a distance between the first plate assembly and the first conductor plane is substantially an integer multiple of a quarter wavelength of the first electromagnetic radiation; and the third plate assembly is positioned substantially parallel to the first conductor plane, and a distance between the third plate assembly and the first conductor plane is substantially an integer multiple of a quarter wavelength of the third electromagnetic radiation.

16. The base station antenna according to claim 13, wherein the first and third arrays of radiating elements are interdigitated on the outer surface of the first backplane, and the first and third plate assemblies overlap with each other in a plan view that is parallel to a major surface of the first plate assembly; and the second and fourth arrays of radiating elements are interdigitated on the outer surface of the second backplane, and the second and fourth plate assemblies overlap with each other in a plan view that is parallel to a major surface of the second plate assembly.

17. The base station antenna according to claim 13, further comprising a radome that houses the first through fourth arrays of radiating elements, wherein the first plate assembly is formed as at least a portion of the radome.

18. The base station antenna according to claim 13, further comprising a radome that houses the first through fourth arrays of radiating elements, at least a portion of the radome comprising a structure with at least two layers, wherein the first plate assembly is formed as a first layer of the two layers, and the third plate assembly is formed as a second layer of the two layers.

19. The base station antenna according to claim 1, further comprising:

a third array of radiating elements that are configured to emit third electromagnetic radiation, wherein a frequency band of the third electromagnetic radiation is different from frequency bands of the first and second electromagnetic radiation; and a third backplane, the third array of radiating elements being disposed on an outer surface of the third backplane, wherein the first and second backplanes are positioned such that an angle between the outer surface of the first backplane and the outer surface of the second backplane is greater than 180 degrees; and the third backplane is positioned between the first and second backplanes such that an emission direction of the third electromagnetic radiation is between the directions of the first and second electromagnetic radiation in the azimuth plane.

20. The base station antenna according to claim 19, further comprising a radome that houses the first through third arrays of radiating elements, wherein the first plate assembly is formed as at least a portion of the radome.

21. The base station antenna according to claim 1, further comprising a radome that houses the first and second arrays of radiating elements, wherein the first plate assembly is formed as at least a portion of the radome.

22. A base station antenna comprising:

a first array of radiating elements that are configured to emit first electromagnetic radiation;

a second array of radiating elements that are configured to emit second electromagnetic radiation;

a first backplane comprising a first conductor plane that is disposed on an inner surface thereof, the first array of radiating elements being disposed on an outer surface of the first backplane;

a second backplane comprising a second conductor plane that is disposed on an inner surface thereof, the second array of radiating elements being disposed on an outer surface of the second backplane, wherein the first and second backplanes are positioned with a mechanical tilt relative to each other such that an emission direction of the first electromagnetic radiation is different from an emission direction of the second electromagnetic radiation in an azimuth plane;

a first plate assembly comprising a first substrate and a plurality of first units that are arranged in an array and disposed on the first substrate, a dimension of the first unit being a sub-wavelength of the first electromagnetic radiation, wherein the first plate assembly is positioned such that the array in which the plurality of first units are arranged receives the first electromagnetic radiation and forms, with the first conductor plane, a first Fabry-Perot cavity for the first electromagnetic radiation; and a second plate assembly comprising a second substrate and a plurality of second units that are arranged in an array and disposed on the second substrate, a dimension of the second unit being a sub-wavelength of the second electromagnetic radiation, wherein the second plate assembly is positioned such that the array in which the plurality of second units are arranged receives the second electromagnetic radiation and forms, with the second conductor plane, a second Fabry-Perot cavity for the second electromagnetic radiation.

23. A base station antenna comprising:

a first array of radiating elements that are configured to emit first electromagnetic radiation;

a second array of radiating elements that are configured to emit second electromagnetic radiation and positioned with a mechanical tilt relative to the first array of radiating elements such that an emission direction of the first electromagnetic radiation is different from an emission direction of the second electromagnetic radiation in an azimuth plane;

a first reflector that is configured to reflect the first electromagnetic radiation outwardly;

a second reflector that is configured to reflect the second electromagnetic radiation outwardly;

a first plate assembly that is configured to reflect a first portion of received electromagnetic radiation inwardly while allowing a second portion of the received electromagnetic radiation to pass outwardly through the first plate assembly, the first plate assembly being positioned to form, with the first reflector, a first Fabry-Perot cavity for the first electromagnetic radiation; and a second plate assembly that is configured to reflect a first portion of received electromagnetic radiation inwardly while allowing a second portion of the received electromagnetic radiation to pass outwardly through the second plate assembly, the second plate assembly being positioned to form, with the second reflector, a second Fabry-Perot cavity for the second electromagnetic radiation.

24. A base station antenna comprising:

a first array of radiating elements that is configured to emit first electromagnetic radiation;

a second array of radiating elements that is configured to emit second electromagnetic radiation;

a first backplane, the first array of radiating elements being disposed on an outer surface of the first backplane, and the first backplane being configured to reflect the first electromagnetic radiation outwardly;

a second backplane, the second array of radiating elements being disposed on an outer surface of the second backplane, and the second backplane being configured to reflect the second electromagnetic radiation outwardly, wherein the first and second backplanes are positioned with a mechanical tilt relative to each other such that a direction of the first electromagnetic radiation is different from a direction of the second electromagnetic radiation in an azimuth plane; and a first plate assembly that is configured to reflect a first portion of received electromagnetic radiation inwardly while allowing a second portion of the received electromagnetic radiation to pass outwardly through the first plate assembly, the first plate assembly being positioned to form, with the first backplane, a first Fabry-Perot cavity for the first electromagnetic radiation.

* * * * *